United States Patent [19]

Staehli

[11] 4,308,715

[45] Jan. 5, 1982

[54] SPINNING RING MADE FROM STEEL FOR RING SPINNING AND RING TWISTING MACHINE

[75] Inventor: Gustav Staehli, Winterthur, Switzerland

[73] Assignee: Rieter Machine Works Ltd., Winterthur, Switzerland

[21] Appl. No.: 196,482

[22] PCT Filed: Aug. 31, 1979

[86] PCT No.: PCT/EP79/00067

§ 371 Date: May 25, 1980

§ 102(e) Date: May 15, 1980

[87] PCT Pub. No.: WO80/00718

PCT Pub. Date: Apr. 17, 1980

[51] Int. Cl.[3] ..... D01H 7/60; C21D 9/40

[52] U.S. Cl. ..... 57/119

[58] Field of Search ..... 57/119, 120, 125; 29/527.4

[56] References Cited

U.S. PATENT DOCUMENTS

| | | | |
|---|---|---|---|
| 3,084,501 | 4/1963 | Kluttz | 57/119 X |
| 3,118,272 | 1/1964 | Clapp | 57/120 |
| 3,226,924 | 1/1966 | Dalpiaz | 57/119 X |
| 3,343,362 | 9/1967 | Lunsford | 57/119 |

*Primary Examiner*—Donald Watkins

*Attorney, Agent, or Firm*—Werner W. Kleeman

[57] ABSTRACT

A spinning ring formed of steel for ring spinning and ring twisting machines is partially hardened, i.e. in a locally limited zone of the spinning ring. At this zone there is located a traveller flange having a traveller guide surface. The spinning ring is consecutively provided in such zone with an outer running-in surface, which is softer in comparison with the hardened steel, and with a hardened core. The running-in layer is provided with an outer ferro-nitride layer adjacent to which there is provided an austenitic-martensitic transition layer containing nitrogen which continuously merges into the structure of the hardened zone, and the austenitic content of which decreases towards the inside, and the hardness of which thus increases. The traveller, upon wearing-off of the ferro-nitride layer can reach the increasingly harder and more wear resistant transition zone. In this manner the required running-in period can be substantially reduced and a reliable and undisturbed operation is ensured even after the running-in period. Owing to the partial hardening which is locally limited to the mentioned zone of the spinning ring, the true dimensions of the spinning ring are maintained.

21 Claims, 4 Drawing Figures

SPINNING RING MADE FROM STEEL FOR RING SPINNING AND RING TWISTING MACHINE

BACKGROUND OF THE INVENTION

The present invention concerns a spinning ring made from steel for ring spinning and ring twisting machines with a traveller guide surface, the spinning ring being provided with a hardened structure and with an outer layer into which a non-metal is incorporated by diffusion.

A known spinning ring of the above mentioned type (e.g. as disclosed in U.S. Pat. No. 2,987,871 or U.S. Pat. No. 3,084,501) is subjected, for manufacture after shaping, to a case-hardening operation at 830° C. and subsequently to a sulfuration process in a salt bath at about 565° C. As a result of such processing a soft sulfur-containing surface layer of a thickness ranging from 50μ to several tenths of a millimeter is obtained. Subsequently a further case-hardening or induction-hardening process is effected at approximately 855° C. for restoring the hardness lost during the sulfuration process. The outer, hardened layer possesses lubricating properties owing to the incorporated sulfur, which permit a reduction of the running in time required for the traveller. This running-in layer, however, can be worn off completely by the traveller. Thus, the ring not only loses the desirable lubricating properties of the traveller guide surfaces, but also the hardened, sulfur-free steel base is laid bare, in such manner that the known disadvantages of welding of the traveller and the ring again prevail. The ring, after completion of the hardening process, furthermore no longer is of the required shape, e.g. roundness, achieved by the shaping process because the shape is impaired, as is well known, by the hardening processes effected at a temperature above the structure transition temperature. A possible unroundness, possibly corrected in the outer layer, thus again influences the traveller on the hardened steel base. The known spinning rings with hardened structure thus do not possess the desired properties required for the finished operable ring.

Another known spinning ring of hardened steel (Swiss Pat. No. 430,522) is provided with an outer surface layer of soft, unhardened steel, of a depth of about 3 to 50μ, which is generated by elimination of the carbon owing to the burning out or annealing during the hardening process, and thus to the avoidance of the structure transformation during the hardening process. Notwithstanding the smoothing action of the traveller during the running-in period during which the soft steel is worn off, a ferritic surface is present due to the decarbonization, which favours the scoring tendency with respect to the traveller. Also with this known spinning ring the disadvantage persists that, as wear of the soft layer progresses, the traveller reaches the hardened steel base, and that e.g. also the correct dimensions of the ring are impaired by the burning out or annealing process which is effected at temperatures above the structure transition temperature. The absence of an alloy component, eliminated during the hardening process, thus does not eliminate the disadvantages of a ring of hardened steel with a non-metal provided in the surface layer.

SUMMARY OF THE INVENTION

It thus is an object of the present invention to eliminate the disadvantages cited and to create a spinning ring of the type initially mentioned with an outer running-in layer on the traveller guide surface, which is to achieve fast passivation of the surface, i.e. reduction of its adhesion tendency, and adaption to the traveller shape, and thus is to achieve reliable operation.

This object is achieved according to the invention in that the ring, in a hardened zone containing the traveller guide surface, is provided with an outer, nitrogen-containing, running-in layer which is softer than the hardened steel, and the hardness of which increases over the cross-section towards the inside.

The invention starts out from the recognition of applying the behaviour of nitrogen and its influence on the steel structure in such manner that in the hardened zone the structure transformation and thus the structure formation in the zone of the spinning ring containing nitrogen, i.e. in the running-in layer, is controlled.

In the ring according to the invention thus an outer ferronitride layer, enriched with nitrogen by diffusion, can be formed, which in the hardening process yields a nitrogen-rich, softer structure containing residual austenite. In this manner the known undesirable effects and properties of the non-metallic component nitrogen in the steel structure and of a hardened structure in a spinning ring can be converted into favourable effects in their combination. In the ring according to the invention the running-in layer thus preferentially is of an austenitic-martensitic structure, the austenitic content of which decreases in the direction towards the hardened steel base as a measure of the nitrogen brought in by diffusion and thus yields a hardness which increases towards the inside. In this manner a structure of the running-in layer can be favourably achieved, which continuously merges into the structure of the hardened steel base, the running-in layer being anchored in the steel base by the nitrogen diffused in or incorporated during the hardening process, and a discontinuous stepwise structure transition from the running-in layer to the hardened steel base is avoided. Using the inventive spinning ring the traveller, as it wears off the running-in layer during the running-in period, gradually can reach the continuously increasing hardness and wear-resistance of the structure of the layer.

The spinning ring according to the invention thus is protected against adhesive scoring wear and against the occurrence of material welded on, which both occur if two metallic materials slide on each other without lubrication, and which has been the case in the arrangements known thus far of a traveller on a spinning ring.

Also after the traveller has worn into the running-in layer a traveller guide surface thus can be provided which owing to its nitrogen-content is highly resistant to scoring and also does not cause the notorious welding of traveller and ring. During the running-in process possible shape deviations present in the running-in surface are eliminated as the running-in layer is softer.

In the spinning ring according to the invention e.g. the running-in layer is smoothed out quickly owing to its reduced hardness in the outer region is such manner that also at traveller speeds e.g. above 30 m/sec no danger of scoring of the traveller guide surface prevails. A considerable reduction of the running-in period without considerable reduction of the normal production speed can be achieved as the traveller continuously can reach a surface of increasing hardness and thus of increasing stability, in which process damage to the traveller guide surface as described e.g. by G. Stähli in "Wear effects on the running surfaces of high speed steel spinning rings" published in Melliand Textilberichte 53 (1972), pages 1101 through 1103 (in German), are avoided. Thus, already after e.g. 1 to 3 doffing cycles, i.e. after a short period, the full production speed, e.g. a traveller speed of 34 m/sec can be carried out, in such manner that e.g. also a time-consuming running-in plan or schedule for ring and traveller can be dispensed with. Lower traveller wear, and thus increased traveller life is achieved, and the number of end breakages thus also can be lowered.

In manufacturing the inventive spinning ring, the non-metallic component nitrogen is incorporated into the surface of the ring of unhardened steel at a temperature below the structure transition temperature after the final shape of the ring has been formed, and an outer, nitrogen-rich ferro-nitride layer is formed. Only after that is the ring hardened at a temperature above the structure transition temperature preferably in a locally limited zone containing the traveller guide surface and limited to that zone, in such manner that the finished shape of the ring can be maintained undeformed, e.g. roundness and planarity being maintained which during hardening of the whole ring body always are impaired, as is well known. The process of partial hardening can be controlled in such manner that a locally limited zone e.g. the whole core of a flange cross-section is hardened or only a hardened layer is obtained, a core of unhardened steel remaining in the flange cross-section.

BRIEF DESCRIPTION OF THE DRAWINGS

The invention is described in more detail in the following with reference to illustrated design examples. There is shown in.

DETAILED DESCRIPTION OF THE PREFERRED EMBODIMENTS

Figure 1:
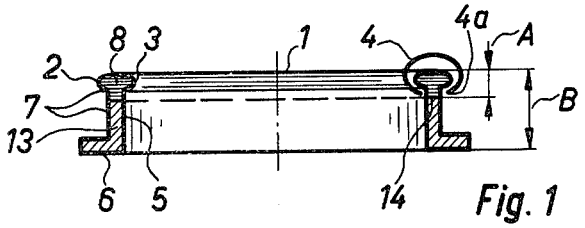
FIG. 1 a schematic cross-section of a spinning ring of steel which can be hardened, FIG. 2 an enlarged view of a part of the spinning ring according to FIG. 1, FIG. 3 an enlarged, schematic cross-sectional view of a spinning ring of steel which can be hardened, and FIG. 4 an enlarged, schematic cross-sectional view of another spinning ring of steel which can be hardened.

A spinning ring 1 made from steel, as used on the ring spinning or on ring twisting machines, comprises an annular upper traveller flange 2 with a traveller guide surface 3 for taking up a traveller 4 guiding a yarn or thread. The flange 2 merges into a ring web 5 which also is annular and which is provided with an annular mounting flange 6 angled off toward the outside for mounting the spinning ring 1 on a ring rail (not shown) of the machine. The spinning ring 1 including the flange 2, the ring web 5 and the mounting flange 6 is made from one piece.

Figure 2:
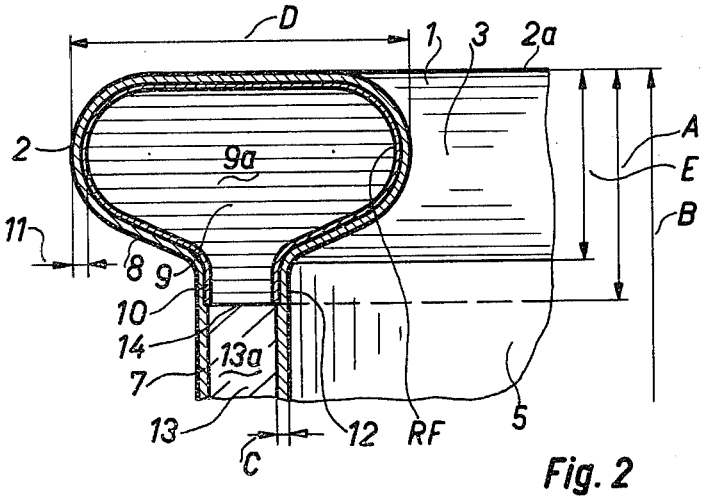

As shown also in FIG. 2 the spinning ring 1 is provided on its whole surface with an outer layer 7 in the steel, which consists of ferro-nitride. In a locally limited zone 8, where the flange 2 with the traveller guide surface 3 is located, the spinning ring 1 of unhardened steel is hardened throughout the whole core 9 of the zone 8, in such manner that in the flange 2 a fully hardened structure ring with a rotation-surface RF determined by the outer profile of the flange 2 is formed. In the zone 8 between the ferro-nitride layer 7 and the hardened steel base in the core 9, i.e. in the hardened structure 9*a* thereof, a transition zone 10 is formed with a hardness lower than the one of the hardened steel base, and which together with the ferro-nitride layer 7 forms in the zone 8 a running-in layer 11 for the traveller 4. The hardened zone 8 extends from a flange upper edge 2*a* over the traveller flange 2 into an immediately adjacent region 12 of the ring web 5, through a height of the spinning ring 1 indicated by reference character A, which is smaller than the total height B of the spinning ring 1. In the region 12 of the ring web 5 the hardened zone neighbours a region 13 of the spinning ring 1 of unhardened steel. The zone height A preferentially is chosen such that all regions of the outer surfaces of the spinning ring 1 contacting parts of the traveller are located within the hardened zone 8. Between the hardened structure 9*a* in the zone 8 and the remaining region 13, in which an unhardened structure 13*a* prevails, a determined or limited structure transition 14 is present, resulting according to the temperature diagram or the temperature gradient, respectively, in the steel material during the hardening process.

For generating the running-in layer 11 the spinning ring 1 which has been manufactured to the desired dimensions suitable for operation is nitrogen-treated throughout its entire surface at a temperature below the structure transition temperature of the steel used, preferentially at 500° to 600° C., e.g. at 560° to 580° C., at which temperature the true dimensions of the ring are maintained. A bath nitration process, e.g. the so-called Tenifer-process, also called Tufftrideprocess, as described in the Durferrit Works News, Issue 35, published in December 1962 by the Degussa Corp., Durferrit Division, Frankfurt/Main, West Germany, can be employed, or e.g. short time gaseous nitration, as described e.g. by G. Stähli et al. in "Comparative studies on bath nitrated and nicotrated probes", published in Material und Technik, 2 (1974), No. 3, page 126–135 (in German). In this process the ferro-nitride layer 7, commonly designated also as connecting zone, is formed in the steel surface, containing e.g. about 10–12 percent weight of nitrogen. Depending on the duration and the intensity of the nitrogen-treatment, and on the steel type processed, a thickness C of the layer 7 of up to about 50$\mu$, e.g. 5–10$\mu$, with a Vickers-hardness exceeding that of the unhardened steel of e.g. 100–200 HV, e.g. with a Vickers hardness of 400–600 HV can be achieved. Nitrogen penetrating in small quantities of less than 0.1 percent by weight by diffusion to a depth of several tenth of a mm below the thickness C of the layer can establish a so-called diffusion layer in the ferritic steel structure of the unhardened steel.

Subsequently the spinning ring 1 is hardened in the locally limited zones, i.e. is hardened partially only by heating it to a temperature above the structure transition temperature of the steel processed, e.g. to 800° to 900° C., and cooling, i.e. hardening it. While the steel is heated to the hardening temperature, nitrogen penetrates by diffusion from the ferro-nitride layer 7 into the steel base towards the inside, a transmission zone of decreasing nitrogen content towards the inside from the layer 7 being established, corresponding to the transition layer 10. During the subsequent hardening process, according to the gradient of the nitrogen content in the transition zone, the transformation of austenitic material into martensitic material is thus hindered, and the transition zone 10 is formed containing a decreasing austenitic content and an increasing martensitic content. Owing to the remaining or residual austenitic content the layer 10 thus is of a lower hardness than the hardened austenitic-free martensitic structure of the steel base of the core 9, and is of an increasing hardness beginning at e.g. a Vickers hardness of about 700 HV, increasing towards the inside to the hardness of the steel base of a Vickers hardness above 700 HV, of e.g. 900 HV.

In the manner described above, the spinning ring 1 can be formed which consecutively contains in the locally limited zone 8 the running-in layer 11 consisting of the still remaining ferro-nitride layer 7 and the transition layer 10 adjacent to it, the hardness of which increases towards the inside, and the core 9 of hardened steel. Upon hardening the spinning ring 1 is of a fine-porous surface. The spinning ring thus preferentially is processed further mechanically, e.g. by grinding or polish-blasting, in such manner that the running-in layer 11 with the outer ferro-nitride layer 7 is bare and is smoothed, there being formed a surface with few pores and free of processing traces and scale. The traveller 4 thus can work first into the soft ferro-nitride layer 7 without disturbance, can wear down this layer quickly and then reaches the transition zone 10 of increasing hardness, damage to the running surface thus being avoided.

The ferro-nitride layer 7 furthermore provides considerably improved corrosion resistance to the spinning ring 1, in such manner that coating the spinning ring 1 e.g. with an anti-corrosion agent can be dispensed with.

The partial hardening of the spinning ring 1 can be effected by electric induction hardening, e.g. using a completely closed, non-overlapping induction coil which is arranged suitably with respect to the part of the ring 1 to be hardened, i.e. the flange 2 thereof, around the outer circumference of which the coil is placed. In this manner the zone 8 can be treated seamlessly, i.e. without any interrupting gap or any overlapping. Owing to the steep temperature gradient in the zone 13 outside the sharply limited electric field the well defined structure transition 14 is established which is easily discernable in a ground cross-section by the naked eye.

The partial hardening of the spinning ring 1 in the zone 8 can be effected, e.g. depending on the steel type processed, on the thickness D and height E of the flange 2, on the desired height A of the zone 8, at a correspondingly adapted intensity, or energy density and/or duration, e.g. using high frequency (HF) or intermediate frequency (IF) induction hardening applied during a short time, e.g. over a duration of only seconds, or over only fractions of a second. Using HF hardening at e.g. a flange thickness D ranging from 3 to 5 mm and a flange height E ranging from 1.5 to 2 mm hardening can be effected in which the hardened structure 9*a* extends from the upper edge 2*a* of the flange 2 over a zone height of e.g. 0.5 to 1.0 mm. Using an IF hardening process the spinning ring 1 can be hardened over a height extending from the upper edge 2*a* into the ring web 5 in the range of 2 to 3 mm. The structure hardening, however, can also be effected by electron beam, laser beam or flame hardening processes. Depending on the shape of the spinning ring and/or the flange, and depending on the hardening process chosen, the hardening over a desired zone height can be effected from the inside or from the outside of the spinning ring. Also a turn-over ring, provided with a double flange and with two hardened zones limited to the two flanges, can be processed.

The steel type chosen preferentially is a flame-hardening type. Steel types which are suitable, are those such as e.g. specified by the ISO standard Nr. 683/XII-1972, such as e.g. a Cf45- or a Cf53-steel, or a steel as specified by DIN standard 17.212, such as e.g. a Cf70-, a 49CrMo4-steel, or a 100Cr6-steel, as disclosed in the steel and iron specification steels Nos. 200 and 350 of the iron works industry standards of the Verein Deutscher Eisenhüttenleute, Düsseldorf, BRD.

Figure 3:
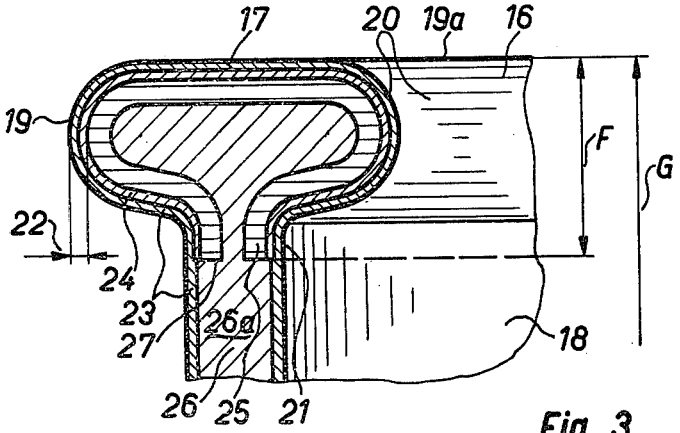

In the embodiment according to FIG. 3 a spinning ring 16, of a type which also can be applied on a ring spinning or a ring twisting machine, is provided with a locally limited hardened zone 17, comprising an upper flange 19 adjacent to a ring web 18 and made together with the latter from one piece, and with a traveller guide surface 20. The zone 17 extends from a flange upper edge 19*a* over the flange 19 into an immediately adjacent region 21 of the ring web 18 over a height F, which is smaller than a partially shown total height G of the spinning ring 16. In the zone 17 a running-in layer 22 is provided in the surface of the steel for a traveller not shown, which running-in layer 22 contains an outer layer 23 containing ferro-nitride, extending over the entire outer surface of the spinning ring 16, adjacent to which there is present in the zone 17 and limited to this zone, a nitrogen-containing transition layer 24, generated by the hardening process, in which there is present an austenitic-martensitic structure with an austenitic content decreasing towards the inside, the hardness of which thus increases towards the inside. Owing to the partial hardening of the spinning ring 16, which can be effected as described with reference to the embodiment according to FIG. 1, a hardened layer 25 is produced in the zone 17 adjacent to the transition zone 24 corresponding to the profile of the flange 19, in such manner that there are present in the hardened zone 17 consecutively the running-in layer 22, the hardened layer 25 and a core 26 of unhardened steel. Between the hardened layer 25 and the unhardened structure 26*a* again a defined and limited structure transition 27 is present. The characteristics of the running-in layer 22 are the same as these described for the running-in layer 11 of the embodiment according to FIGS. 1 and 2. The profile-hardening can be effected e.g. by a so-called impulse hardening process within a fraction of a second, e.g. in the range of milliseconds, as e.g. described by G. Stähli in "The short-time surface hardening of steel by energy-rich impulses" published (in German) in Material und Technik 1974, No. 4, pages 163 through 171. The hardening in the zone 17, limited to the profile presents the advantage that the danger of deformation of the spinning ring, and thus e.g. the occurrence of unroundness, can be reduced further.

Figure 4:
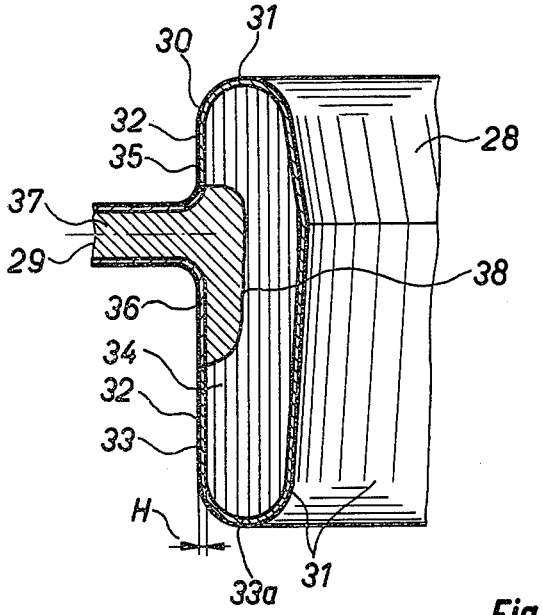

The embodiment according to FIG. 4 illustrates a spinning ring 28 of steel with a ring web 29 and with a flange 30 provided thereon, with a traveller guide surface 31 and with a hardened zone 32 which is locally limited to a part of the spinning ring 28 containing the flange 30. In the zone 32 a running-in layer 33 is present in the surface of the steel, adjacent to which a hardened steel base 34 is present. The running-in layer 33 consists over its whole thickness H from the outer surface 35 of the flange 30 of an austenitic-martensitic structure 33*a*, containing nitrogen and the austenitic content of which decreases towards the inside, and which merges continuously into the hardened steel base 34, in such manner that again the hardness of the running-in layer 33 increases towards the inside. By suitably controlling the processing temperatures in hardening a previously established ferro-nitride layer 36 in the surface of the unhardened steel it can be achieved that the ferro-nitride is decreased and that residual austenite is formed in the layer 33 extending to the outer surface 35. Owing to the partial hardening of the spinning ring 28 again a structure transition 38 is present between the hardened structure 33*a* of the steel base 34 and an unhardened region 37 of the spinning ring 28.

While there are shown and described present preferred embodiments of the invention, it is to be distinctly understood that the invention is not limited thereto, but may be otherwise variously embodied and practiced within the scope of the following claims. Accordingly,

What I claim is:

1. A spinning ring fabricated from steel for ring twisting machines, comprising:

a traveller guide surface provided for said spinning ring;

said spinning ring containing a hardened structure formed of steel;

said spinning ring containing a hardened zone which includes said traveller guide surface;

said hardened zone comprising an outer running-in layer which contains nitrogen;

said outer running-in layer being softer in comparison to the hardened steel of the spinning ring; and the hardness of said outer running-in layer increasing over the cross-section of said spinning ring from the outside towards the inside thereof.

2. The spinning ring as defined in claim 1, wherein:

said spinning ring contains an unhardened portion;

said hardened zone being locally limited essentially to that portion of the spinning ring containing said traveller guide surface and being disposed adjacent to said unhardened portion of the spinning ring.

3. The spinning ring as defined in claim 2, wherein:

said spinning ring contains a core; and the entire core of that portion of the spinning ring containing the traveller guide surface being hardened.

4. The spinning ring as defined in claim 2, wherein:

said hardened zone consecutively contains said running-in layer, a hardened layer and a core of unhardened steel.

5. The spinning ring as defined in claim 2, wherein:

said running-in layer contains an outer layer formed of ferro-nitride;

said ferro-nitride layer being present at the entire outer surface of the spinning ring;

said running-in layer further including a austenitic-martensitic transition layer containing nitrogen and having increasing hardness; and said outer layer of ferro-nitride continuously merging at the region of the hardened zone by means of said transition layer into the structure of the hardened zone.

6. The spinning ring as defined in claim 1, wherein:

said hardened zone possesses a Vicker's hardness exceeding 700 HV.

7. The spinning ring as defined in claim 2, further including:

a well defined transition located between said locally limited hardened zone and said unhardened portion of the steel of the spinning ring.

8. The spinning ring as defined in claim 7, wherein:

said transition comprises a transition region formed by a hardening process of high energy density.

9. The spinning ring as defined in claim 8, wherein:

said hardening process is accomplished by electric induction hardening.

10. The spinning ring as defined in claim 8, wherein:

said hardening process is accomplished by electron beam hardening.

11. The spinning ring as defined in claim 8, wherein:

said hardening process is accomplished by laser beam hardening.

12. The spinning ring as defined in claim 1, wherein:

said steel of said spinning ring is flame-hardenable.

13. The spinning ring as defined in claim 1, wherein:

said steel of said spinning ring is selected from the group consisting essentially of 100 Cr6, Cf45, Cf53, Cf70 and 49CrMo4-steels.

14. The spinning ring as defined in claim 2, wherein:

said hardened zone and said unhardened portion are contained in a spinning ring formed of one piece.

15. The spinning ring as defined in claim 2, wherein:

a structure ring hardened throughout its entire circumference is provided at the locally limited hardened zone and located beneath said running-in layer.

16. The spinning ring as defined in claim 1, wherein:

said running-in layer comprises a nitrogen-rich austenitic-martensitic layer of increasing hardness which continuously merges into the structure of the hardened zone.

17. The spinning ring as defined in claim 1, wherein:

a portion of said spinning ring containing said hardened zone comprises a traveller flange arranged on a ring web.

18. The spinning ring as defined in claim 17, wherein:

said hardened zone extends over the traveller flange into an immediately adjacent region of the ring web.

19. The spinning ring as defined in claim 1, wherein:

said spinning ring contains a fine-porous surface at the hardened zone.

20. The spinning ring as defined in claim 1, wherein:

said spinning ring is provided with a surface containing very few pores in the hardened zone.

21. The spinning ring as defined in claim 1, wherein:

said hardened zone possesses a height which is smaller than the total height of the spinning ring.

* * * * *